US007158733B2

(12) United States Patent
Doi et al.

(10) Patent No.: US 7,158,733 B2
(45) Date of Patent: Jan. 2, 2007

(54) IMAGE FORMING APPARATUS WHICH INCLUDES AN IMAGE BEARING BODY SURFACE POTENTIAL DETECTION FEATURE

(75) Inventors: Koji Doi, Yokohama (JP); Ryuta Mine, Toride (JP); Junji Ishikawa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 38 days.

(21) Appl. No.: 11/078,368

(22) Filed: Mar. 14, 2005

(65) Prior Publication Data

US 2005/0214007 A1 Sep. 29, 2005

(30) Foreign Application Priority Data

Mar. 23, 2004 (JP) ..... 2004-085804

(51) Int. Cl.
*G03G 15/06* (2006.01)

(52) U.S. Cl. ..... 399/55; 399/56

(58) Field of Classification Search ..... None
See application file for complete search history.

(56) References Cited

FOREIGN PATENT DOCUMENTS

JP 8-201461 8/1996

OTHER PUBLICATIONS

Computer translation of cited reference JP08-201461A.*

* cited by examiner

*Primary Examiner*—Quana Grainger
(74) *Attorney, Agent, or Firm*—Fitzpatrick, Cella, Harper & Scinto

(57) ABSTRACT

An image forming apparatus includes an image bearing body which can bear an electrostatic image; a bias member to which a predetermined bias is applied from a bias applying device; and a surface potential detection device which detects a surface potential at the image bearing body. The surface potential detection device includes a detector portion which generates a signal corresponding to the surface potential at the image bearing body and a potential detection portion which detects the surface potential by the signal from the detector portion. In the image forming apparatus, the potential detection portion is also used for detection of a bias value which the bias applying device applies to the bias member, the bias applying device is controlled based on the detection result of the bias which the bias applying device applies, and the bias detection result is obtained by the potential detection unit.

7 Claims, 12 Drawing Sheets

IMAGE FORMING APPARATUS WHICH INCLUDES AN IMAGE BEARING BODY SURFACE POTENTIAL DETECTION FEATURE

BACKGROUND OF THE INVENTION

1. Field of the Invention

The present invention relates to an image forming apparatus such as an electrophotographic printer and an electrophotographic copying machine.

2. Related Background Art

FIG. 13 shows a development bias circuit and a surface potential measurement circuit as a configuration example of an image producing (image forming) control circuit in the image forming apparatus such as the electrophotographic printer and the electrophotographic copying machine. At this point, the conventional development bias circuit will be described as an example of bias generation circuits. Because a constant-voltage system bias generation circuit such as grid bias has the same configuration and control method, the description of the constant-voltage system bias generation circuit is omitted.

In FIG. 13, the reference numeral 11*a* denotes a photoconductor drum which is rotated in the direction of arrow R1, the reference numeral 12*a* denotes a primary charger which evenly charges a surface of the photoconductor drum 11*a*, the reference numeral 18*a* denotes a surface potential sensor which detects a surface potential at the photoconductor drum 11*a*, and the reference numeral 14*a* denotes a development device which develops an electrostatic latent image on the photoconductor drum 11*a*.

The reference numeral 70*a* shows the configuration of the development bias circuit. The development bias circuit 70*a* has a direct-current bias generation portion 71*a*, a generation bias detection portion 72*a*, and a direct-current bias control portion 73*a*. The reference numeral 90*a* shows the configuration of the surface potential measurement circuit. The surface potential measurement circuit 90*a* has a sensor control portion 91*a*, a sensor direct-current bias generation portion 92*a*, a sensor generation bias detection portion 93*a*, and a detection-signal transmission portion 94*a*. The reference numeral 95 shows an apparatus control portion which controls the image forming apparatus. The apparatus control portion 95 has a D/A conversion portion 96*a* whose output portion is connected to the development bias circuit 70*a* and an A/D conversion portion 97*a* whose output portion is connected to the surface potential measurement circuit 90*a*.

In the image producing control circuit having the above configuration, the development bias circuit 70*a* is operated according to a control signal from the apparatus control portion 95. At first the apparatus control portion 95 directs the development bias circuit 70*a* to output a desired bias output value by an analog signal level through the D/A conversion portion 96*a*. In the development bias circuit 70*a*, the direct-current bias control portion 73*a* receives the analog signal. In response to the signal from the D/A conversion portion 96*a*, the direct-current bias control portion 73*a* operates direct-current bias generation portion 71*a* to cause the direct-current bias generation portion 71*a* to generate a direct-current bias which is of a development bias. The direct-current bias generated in the above way is converted into a detection signal by the generation bias detection portion 72*a*, and the detection signal is transmitted to the direct-current bias control portion 73*a*. The direct-current bias control portion 73*a* compares the detection signal to the analog signal from the D/A conversion portion 96*a*, and the direct-current bias control portion 73*a* transmits the control signal to the direct-current bias generation portion 71*a* so that the detection signal and the analog signal agree with each other.

Then, the surface potential measurement circuit 90*a* is also controlled by the apparatus control portion 95. The sensor control portion 91*a* transmits a drive signal to the surface potential sensor 18*a*. The surface potential sensor 18*a* is operated according to the drive sensor to send out a measurement signal following the potential difference between the surface potential sensor 18*a* and the photoconductor drum 11*a*. The sensor control portion 91*a* receives the signal to operate the sensor direct-current bias generation portion 92*a* so that the signal is minimized, i.e. the surface potential at the photoconductor drum 11*a* becomes equal to the potential at the surface potential sensor 18*a*.

Thus, the surface potential at the photoconductor drum 11*a* and the generation bias value of the sensor direct-current bias generation portion 92*a* is controlled so as to become the same potential. On the other hand, the sensor generation bias detection portion 94*a* converts the generation bias of the sensor direct-current bias generation portion 92*a* into the detection signal to transmit the detection signal to the A/D conversion portion 97*a* through the detection signal transmission portion 94*a*. The A/D conversion portion 97*a* performs digital conversion of the detection signal to notify the apparatus control portion 95 of the detection result.

With reference to a technique of improving detection accuracy of the surface potential sensor, Japanese Patent Application Laid-Open No. H08-201461 discloses a method in which switch means for switching the photoconductor drum to a floating state is provided, a reference voltage is provided to the photoconductor drum in the floating state, and detection properties are corrected by measuring the potential at the photoconductor drum with a potential sensor.

However, according to the above-mentioned image forming apparatus, the surface potential sensor measurement circuit of the photoconductor drum and the bias circuit which performs an image producing process such as the development bias individually have the bias detection circuit. Further, the bias detection circuits are separately attached to different places due to constraints of an apparatus space. Therefore, variations in components constituting the detection circuit, temperature characteristics of the components, variations in temperature environment, and the like affect subtly detection characteristics and detection errors of the components, which generates variations in potential detection result and bias output control result. As a result, there is the problem that image densities differ from one another among the apparatuses, or the problem that difference in image density is generated according to temperature change among the apparatuses even if the image densities agree with one another under a certain condition.

Even in the same apparatus, there is the problem that the image density fluctuates according to the temperature change in the apparatus. In the case of the color image forming apparatus, there is the problem that color tint of the image is changed.

Because the temperature change in the apparatus is largely generated during continuous print in which plural sheets are printed, there is the problem that the initial print sheet differs from the print sheet, which is printed after a certain time elapses, in the image density and the initial color tint during continuous printing.

A surface temperature of the photoconductor drum varies during continuous printing, which changes a surface potential VL (light section potential) of the photoconductor drum in the maximum exposure. Therefore, there is generated the problem that the image density and the color tint are changed.

The temperature change in a bias measurement system in a primary grid changes a dark section potential VD and the light section potential VL, which generates the problem that the image density and the color tint are fluctuated.

When the light section potential VL is measured during the continuous print, sometimes there is the problem that a fog image is generated in the measurement to shorten a life of the cleaning device of the photoconductor drum.

Because the above problems are generated in each photoconductor drum, the same problems including the difference in color tint exist with respect to the fluctuation in image quality.

In the A/D conversion of the potential measurement detection result, or in the bias output detection result and the A/D conversion during the digital control of the bias circuit, since each circuit has a quantization error, and sometimes a mutual shift caused by the quantization error emerges by adding the mutual shift to a measurement error, which generates the problem that the image density is further changed.

According to the method disclosed in Japanese Patent Application Laid-Open No. H08-201461, the measurement accuracy can be increased based on the development bias output by utilizing the development bias generation device which is of the bias generating means for applying the reference voltage. However, in the case where the development bias output itself is changed due to the temperature change, there is the problem that a relationship between a charged potential and a development potential cannot be kept constant. Although the problem can be solved by repeating correction control, it is necessary that the photoconductor drum is in the floating state. Therefore, because it is necessary to stop the image forming process, the correction cannot be realized without interrupting the printing during the continuous print.

SUMMARY OF THE INVENTION

In view of the foregoing, an object of the invention is to provide an image forming apparatus which can stably form an image by detecting potential more stably.

In order to achieve the object, an image forming apparatus according to the invention including:

an image bearing body which can bear an electrostatic image;

an bias member which is provided opposite to the image bearing body and to which a predetermined bias is applied;

bias means which applys the predetermined bias to the bias member;

surface potential detection means which detects a surface potential at the image bearing body, the potential detection means including a detector portion which generates a signal corresponding to the surface potential at the image bearing body and potential detection means which detects the surface potential by the signal from the detector portion, wherein the potential detection means is also used for detection of a bias value which the bias means applies to the bias member; and control means which controls the bias means based on the detection result of the bias which the bias means applies to the bias member, the bias detection result being obtained by the potential detection means.

DETAILED DESCRIPTION OF THE EMBODIMENTS

Figure 1:
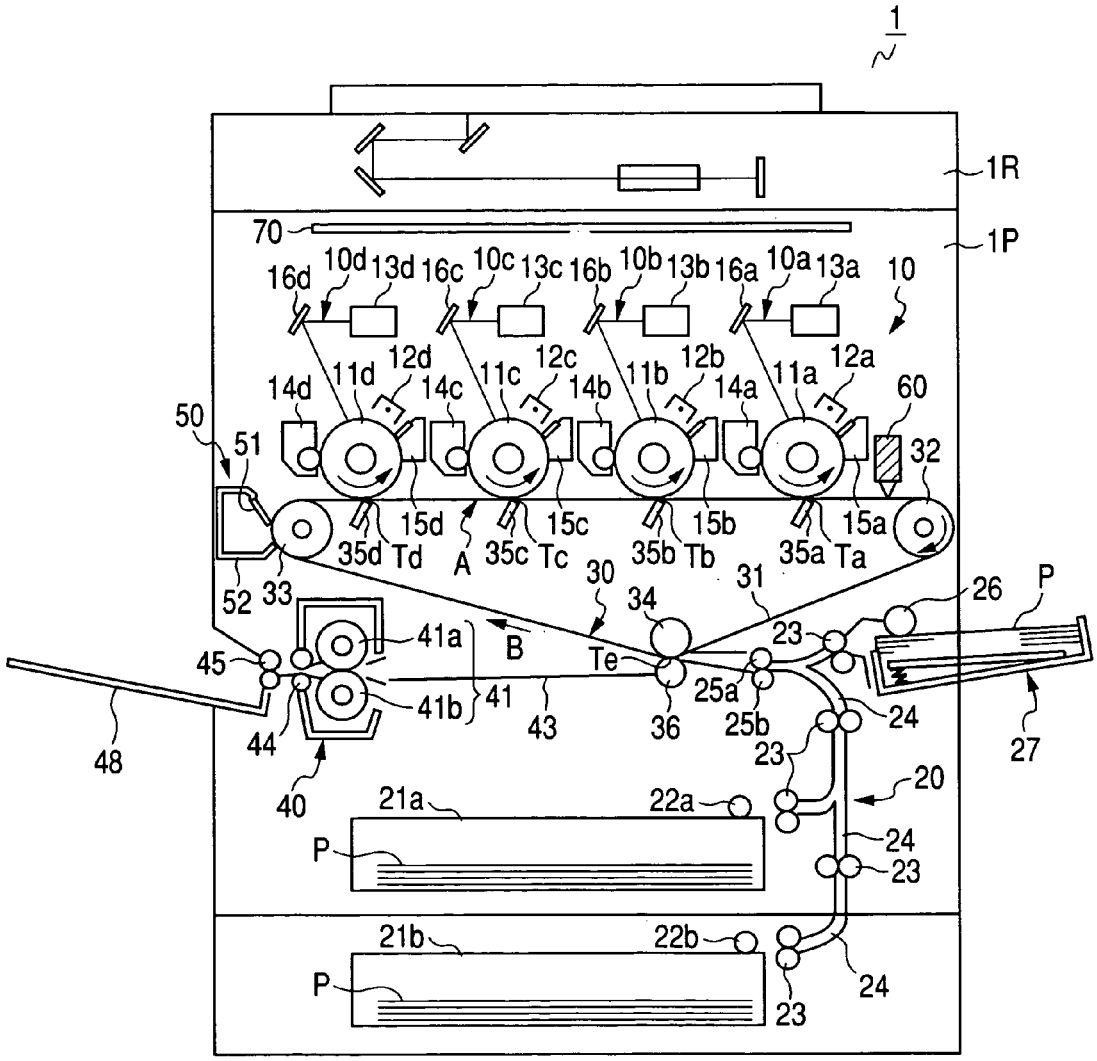
FIG. 1 is a longitudinal sectional view showing a schematic configuration of an image forming apparatus.

Referring now to the accompanying drawings, preferred embodiments of the invention will be described. In the drawings, the same constituent having the same configuration or action is indicated by the same reference numeral and sign. A redundant description regarding the same constituent shall be omitted as appropriate.

First Embodiment

FIG. 1 is a longitudinal sectional view showing a main part of an image forming apparatus to which the invention can be applied. In FIG. 1, an image forming apparatus 1 is an electrophotographic image forming apparatus. The image forming apparatus 1 includes a reader portion (optical system) 1R in an upper part of the image forming apparatus 1 and a printer portion (image output portion) 1P in a lower part. The reader portion 1R reads an image of a manuscript, and the printer portion 1P forms the image (toner image) in a transfer material P based on image information from the reader portion 1R. The image forming apparatus 1 has plural (four) image forming stations (image forming portion in narrow sense) 10*a*, 10*b*, 10*c*, and 10*d* which are arranged in parallel in an image forming portion (image forming portion in a broad sense) 10. An intermediate transfer body method is used for the image forming apparatus 1. Particularly the invention is effectively applied to the image forming apparatus to which the intermediate transfer body method is used.

The printer portion 1P mainly includes an image forming portion 10, a paper-feed portion 20, an intermediate transfer portion 30, a fixing portion 40, and a control portion 80 (not shown).

The image forming portion 10 includes the four image forming stations 10*a*, 10*b*, 10*c*, and 10*d* having the substantially same configuration. Yellow (Y), cyan (C), magenta (M), and black (K) toner images are sequentially formed in the four image forming stations 10*a*, 10*b*, 10*c*, and 10*d*. Drum-shaped electrophotographic conductor bodies (hereinafter referred to as hotoconductor drum 11*a*, 11*b*, 11*c*, and

11*d* which are of an image bearing body are journaled in the center of the image forming stations 10*a*, 10*b*, 10*c*, and 10*d* respectively. The photoconductor drums are rotated in the direction of their respective arrows (counterclockwise direction in FIG. 1). Primary chargers (charging means) 12*a*, 12*b*, 12*c*, and 12*d*, exposure devices (irradiating means) 13*a*, 13*b*, 13*c*, and 13*d* which are of an exposure device, folding mirrors 16*a*, 16*b*, 16*c*, and 16, and development devices (bias member) 14*a*, 14*b*, 14*c*, and 14*d* are respectively arranged in a rotating direction of the photoconductor drums 11*a* to 11*a* while being opposite outer surfaces of the photoconductor drums 11*a* to 11*d*.

Figure 5:
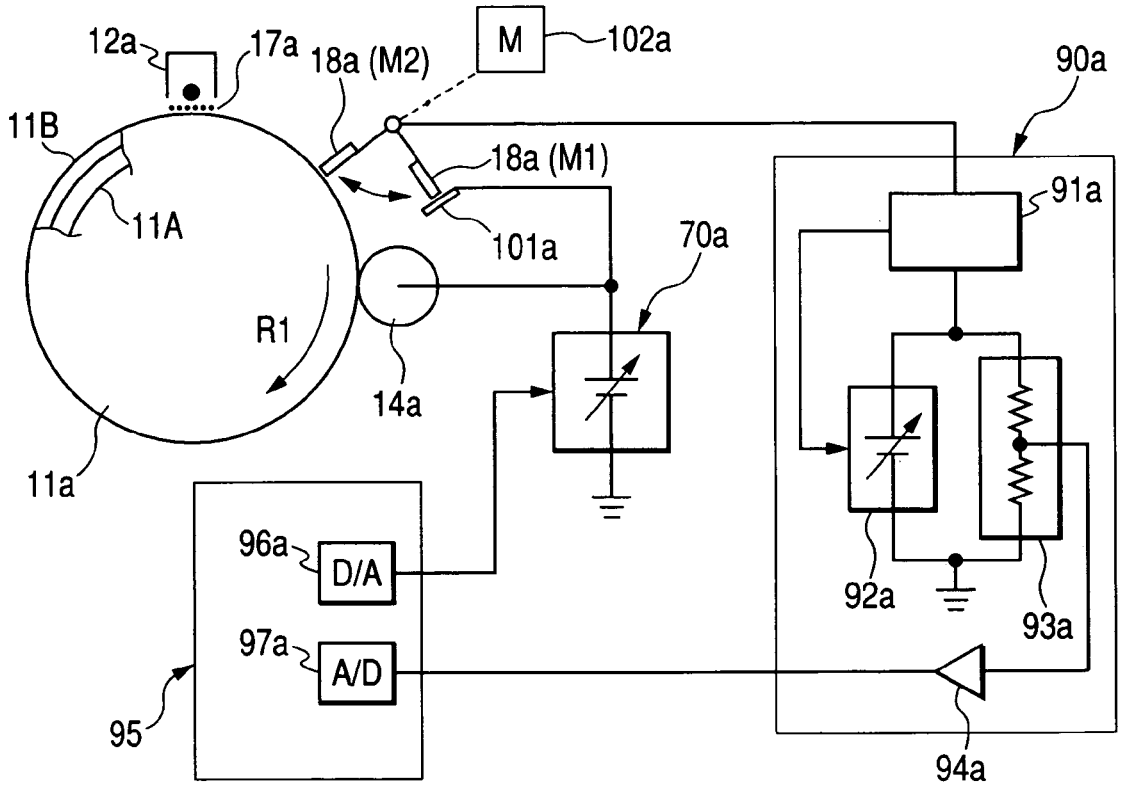
FIG. 5 shows an electric block diagram for explaining a first embodiment.

As shown in a part of the photoconductor drum 11*a* of FIG. 5, each of the photoconductor drum 11*a* to 11*d* has an electrically conductive drum substrate (base layer) 11A which is grounded and a photoconductor layer 11B which is provided so that the outer surface of the drum substrate 11A is covered with the photoconductor layer 11B.

Each of the primary chargers 12*a* to 12*d* provides a uniform amount of charge to the surface (hereinafter simply referred to as photoconductor drum surface) of each photoconductor layer 11B of the photoconductor drums 11*a* to 11*d*. Then, the exposure devices 13*a* to 13*d* modulate a light beam (exposure light) such as a laser beam according to a recording image signal to expose the photoconductor drums 11*a* to 11*d* with the light beams through the folding mirrors 16*a* to 16*d*, which forms the electrostatic latent image on the photoconductor drums 11*a* to 11*d*.

The electrostatic latent image is visualized as a toner image (development image) by the development devices 14*a* to 14*d* in which development agents (hereinafter referred to as "toner") such as yellow, cyan, magenta, and black color development agents are stored respectively. The visualized toner image is transferred (primary transfer) in image transfer areas Ta, Tb, Tc, and Td of an intermediate transfer belt 31 which is of an intermediate transfer body.

When the photoconductor drums 11*a* to 11*d* are rotated, on the downstream side where the photoconductor drums 11*a* to 11*d* pass through the image transfer areas Ta to Td, cleaning devices 15*a*, 15*b*, 15*c*, and 15*d* clean the photoconductor drum surface by wiping out the toner which is not transferred to intermediate transfer belt 31 but remains on the photoconductor drums 11*a* to 11*a*. Thus, the image formation performed through the above process with each toner is sequentially performed.

The paper-feed portion 20 includes cassettes 21*a* and 21*b*, a manual feed tray 27, pickup rollers 22*a*, 22*b*, and 26, plural pairs of conveying rollers 23, plural paper-feed guides 24, and registration rollers 25*a* and 25*b*. The sheets of transfer material P are stored in the cassettes 21*a* and 21*b*. Each of the pickup rollers 22*a*, 22*b*, and 26 delivers the sheet of transfer material P one by one from the cassettes 21*a* and 21*b* or the manual feed tray 27. The plural pairs of conveying rollers 23 and the plural paper-feed guides 24 convey the transfer material P delivered from each of the pickup rollers 22*a*, 22*b*, and 26 to the registration rollers 25*a* and 25*b*. The registration rollers 25*a* and 25*b* deliver the transfer material P to a secondary transfer area Te in synchronization with image forming timing of the image forming portion 10.

An endless intermediate transfer belt 31 is provided in the intermediate transfer portion 30. The intermediate transfer belt 31 is entrained about three rollers, i.e. a drive roller 32 which transfer drive to the intermediate transfer belt 31, a driven roller 33 which is rotated while following the rotation of the intermediate transfer belt 31, and a secondary transfer opposing roller 34 which is located opposite to the secondary transfer area Te while sandwiching the intermediate transfer belt 31. A primary transfer plane A is formed between the drive roller 32 and the driven roller 33. In the drive roller 32, the surface of a metal roller is coated with rubber (urethane or chloroprene) having a thickness of several millimeters in order to prevent a slip between the drive roller 32 and the intermediate transfer belt 31. The drive roller 32 is rotated in the direction of the arrow by a pulse motor (not shown), which rotates the intermediate transfer belt 31 in the direction of arrow B.

The primary transfer plane A is opposite the image forming portions 10*a* to 10*d*, and the photoconductor drums 11*a* to 11*d* are configured to be opposite to the primary transfer plane A of the intermediate transfer belt 31. Accordingly, the primary transfer areas Ta to Td are located in the primary transfer plane A. In the primary transfer areas Ta to Td where the photoconductor drums 11*a* to 11*a* are opposite to the intermediate transfer belt 31, primary transfer chargers 35*a*, 35*b*, 35*c*, and 35*d* are arranged on the backside of the intermediate transfer belt 31. A secondary transfer roller 36 is arranged opposite to the secondary transfer opposing roller 34, and the secondary transfer area Te is formed by a nip between the secondary transfer roller 36 and the intermediate transfer belt 31. The secondary transfer roller 36 is pressed against the intermediate transfer belt 31 with proper pressure. On the downstream of the secondary transfer area Te on the intermediate transfer belt 31, a belt cleaner 50 is provided at a position corresponding to the driven roller 33. The belt cleaner 50 has a cleaning blade 51 and a waste-toner box 52. The cleaning blade 51 cleans the image forming plane (surface) of the intermediate transfer belt 31, and the waste-toner box 52 which is wiped out by the cleaning blade 51.

The fixing portion 40 includes a fixing device 41, a guide 43, a pair of inner paper-discharge rollers 44, and a pair of outer paper-discharge rollers 45. The fixing device 41 has a fixing roller 41*a* which includes a heat source such as a halogen lamp heater inside the fixing roller 41*a* and a pressing roller 41*b* which is pressed against the fixing roller 41*a*. (In some cases, the pressing roller 41*b* includes the heat source inside the pressing roller 41*b*.) The guide 43 guides the transfer material P to the nip portions of the pair of the fixing roller 41*a* and the pressing roller 41*b*. The pair of inner paper-discharge rollers 44 and the pair of outer paper-discharge rollers 45 further discharge the transfer material P delivered from the pair of the fixing roller 41*a* and the pressing roller 41*b* to a paper-discharge tray 48 located outside the image forming apparatus.

Then, the image producing (image forming) process will be described in detail referring to FIG. 2. The image forming station 10*a* will be described here as a representative of the image forming portion 10. Needless to say, the image forming stations 10*b*, 10*c*, and 10*d* have the configuration.

Figure 2:
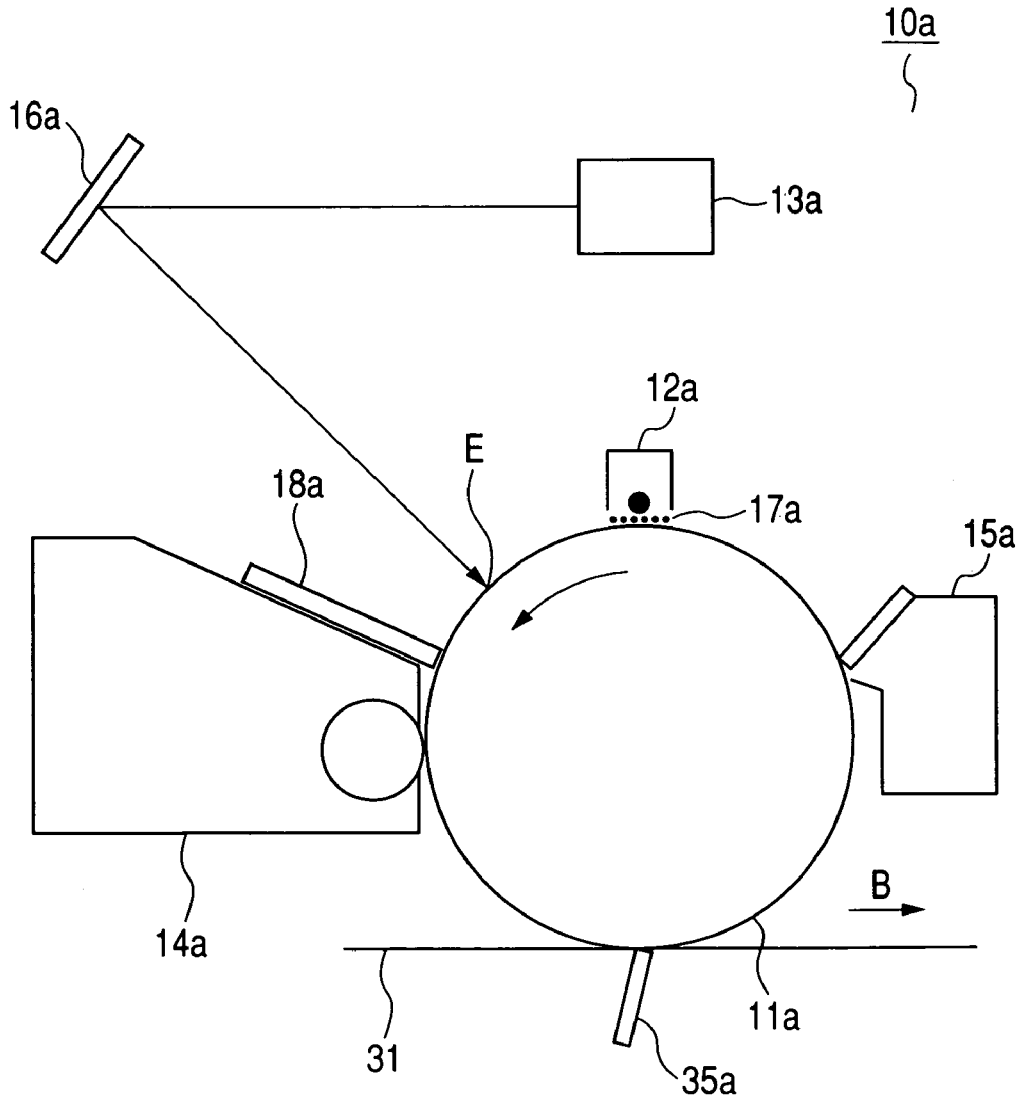
FIG. 2 shows a schematic configuration of an image producing portion (image forming portion) of the image forming apparatus.

A primary grid 17*a* and a surface potential sensor 18*a* are shown in FIG. 2 while the primary grid 17*a* and the surface potential sensor 18*a* are neither described nor shown in FIG. 1. The primary grid 17*a* is an electrode which is set to a predetermined voltage, and the primary grid 17*a* is provided between the primary charger 12*a* and the photoconductor drum 11*a* in parallel with the primary charger 12*a*. The primary grid 17*a* adjusts a current flowing into the photoconductor drum 11*a* from the primary charger 12*a*, which allows the amount of charge on the surface of the photoconductor drum 11*a* to be controlled. The surface potential sensor 18*a* is provided on the downstream side of the exposure position (position irradiated with the laser beam from the exposure device 13*a*) along the rotating direction of the photoconductor drum 11*a* and on the upstream side of the development device 14*a*. The surface potential sensor 18*a* measures the charge potential on the surface of the photoconductor drum 11*a*, which enables the stabilization of the image density and the control of the image quality.

Figure 3:
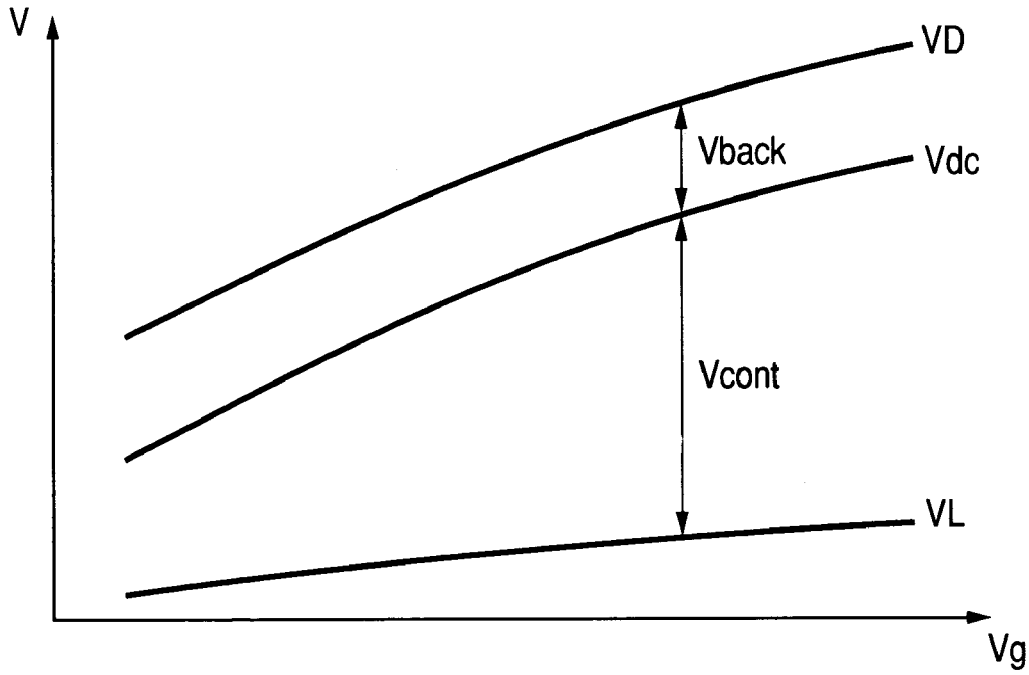
FIG. 3 shows a relationship between a grid potential at a primary charger and a surface potential at a photoconductor drum.

FIG. 3 shows charging characteristics of the photoconductor drum 11*a*. The charge characteristics indicates the relationship between the surface potential at the photoconductor drum 11*a* and the development bias applied to the development device 14*a*, and the relationship determines the image quality. In FIG. 3, a horizontal axis represents a setting potential (grid potential). Vg in which the primary grid 17*a* is set, and a vertical axis represents the surface potential (potential amount) V. The sign VD denotes the dark section potential (after the photoconductor drum surface is charged, the surface potential at photoconductor drum 11*a* when the exposure is not performed), the sign VL denotes the light section potential (the surface potential at the photoconductor drum 11*a* when the exposure is performed at the maximum level), and the sign Vdc denotes the setting potential at the development bias.

The charge amount V of the photoconductor drum 11*a* tends to increase as the setting voltage Vg of the primary grid 17*a* is increased. The increase in dark section potential VD in FIG. 3 shows the characteristics. The light section potential VL tends to increase as the dark section potential VD is increased, and the light section potential VL in FIG. 3 shows the characteristics.

The setting value of the development bias is determined by permissible value of a fog amount in a portion where the image is not formed. The reason why the fog is generated is that the toner having the different charge amount which exists exceptionally in the development device 14*a* (for example, the toner having the exceptionally higher charge amount) possesses enough potential to develop the light section potential VD. Accordingly, the development bias Vdc is set to the level in which the exceptional toner is slightly attracted with respect to the dark section potential so that the fog caused by the exceptional toner is not generated. The potential from the development bias Vdc, which does not attract the exceptional toner, is referred to as fog eliminating potential Vback, and the potential is usually set in the range from about 100V to about 200V. Thus, the development bias Vdc is determined, and the gradation (contrast) expression between the light and the dark is performed by a contrast potential Vcont between the light section potential VL and the development bias Vdc.

Figure 4:
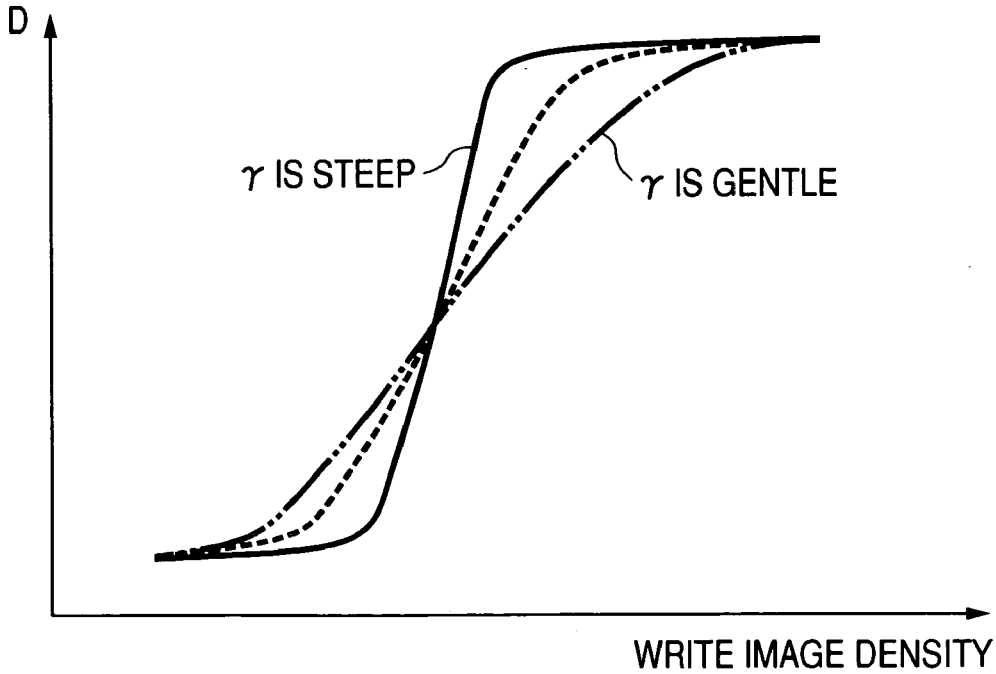
FIG. 4 shows a relationship between write image density and density of a development image developed with toner.

Then, FIG. 4 shows another gradation characteristic which determines the image quality. In FIG. 4, the horizontal axis represents the image density when the write is performed on photoconductor drum 11*a* by the laser beam, and the vertical axis represents the density of the development image which is developed with the toner. As shown in FIG. 4, in the formed toner image, the density of the development image has saturation areas in the light section and the dark section. Usually the characteristics are refeffed to as gamma (γ) characteristics. The γ characteristics directly show the above engine of the image forming apparatus, and the γ characteristics are determined by the photoconductor drum or the toner used, process speed of the image formation, and the like. Because the γ characteristics are expressed in the contrast potential Vcont, when the contrast potential Vcont becomes narrow, the write density largely affects the change in density of the toner image, i.e. γ is steep. On the contrary, when the contrast potential Vcont becomes broad, γ is gentle. In the case where γ is steep, usually the toner image whose contrast is clear can be formed. In the case where γ is gentle, usually the toner image in which the halftone is amply expressed can be formed.

FIG. 5 is a block diagram showing the configuration of the image forming apparatus to which the invention can be applied.

In FIG. 5, the reference numeral 11*a* denotes the photoconductor drum which is rotated in the direction of arrow R1, the reference numeral 12*a* denotes the primary charger which evenly charges the surface of the photoconductor drum 11*a*, the reference numeral 17*a* denotes the primary grid which can adjust the current flowing into the photoconductor drum 11*a* from the primary charger 12*a* to control the charge amount on the surface of the photoconductor drum 11*a*, the reference numeral 18*a* denotes the surface potential sensor which detects the surface potential at the photoconductor drum 11*a*, and the reference numeral 14*a* denotes the development device which develops the electrostatic latent image on the photoconductor drum 11*a*.

The reference numeral 70*a* shows the configuration of the development bias circuit. The development bias circuit 70*a* includes a grounded direct-current bias generation portion.

The reference numeral 90*a* denotes the configuration of the surface potential measurement circuit (surface potential measurement means) 90*a*. The surface potential measurement circuit 90*a* has the sensor control portion 91*a*, the sensor direct-current bias generation portion 92*a*, the sensor generation bias detection portion (first bias detection means) 93*a*, and a detection signal transmission portion 94*a*. The reference numeral 95 shows the apparatus control portion which controls the image forming apparatus. The apparatus control portion 95 has the D/A conversion portion 96*a* whose output portion is connected to the development bias circuit 70*a* and the A/D conversion portion 97*a* whose output portion is connected to the surface potential measurement circuit 90*a*. The surface potential measurement circuit 90*a* and the surface potential sensor 18*a* constitute the surface potential measurement means.

The reference numeral 101*a* denotes a development bias measurement electrode to which the development bias signal for the development device 14*a* is conducted. The reference numeral 102*a* denotes a motor which is of moving means for the surface potential sensor 18*a* between the measurement position (development bias measurement position M1) of the development bias measurement electrode 101*a* and the measurement position (surface potential measurement position M2) of the photoconductor drum 11*a*.

In the image forming apparatus having the configuration shown in FIG. 5, first the apparatus control portion 95 moves the surface potential sensor 18*a* to the development bias measurement position M1 opposite to the development bias measurement electrode 101*a* using the motor 102*a*. Then, the apparatus control portion 95 sets the generation bias to the development bias circuit 70*a* through the D/A conversion portion 96*a*. The development bias circuit 70*a* performs the bias generation control according to the setting, and the development bias circuit 70*a* generates the bias output to the development device 14*a* and the development bias measurement electrode 101*a* according to the setting. In the state of things, the surface potential measurement circuit 90*a* performs the potential measurement to measure the output bias value of the development bias.

Then, the apparatus control portion 95 causes the development bias circuit 70*a* to change the generating bias value, and the development bias measurement is performed again. Thus, the output change and measurement of the development bias are repeated in plural times, and the characteristics of the generation bias value for the setting of the development bias circuit 70*a* are computed based on the measurement result of the surface potential measurement circuit 90*a*. The computation is performed as follows.

At this point, the case where linear approximation is performed by two-point measurement will de described. It is assumed that the bias value is set to V1 at the first point, the measurement result at the first point by the surface potential measurement circuit 90*a* is set to E1. The bias value is set to Vs at the second point, and the measurement result by the surface potential measurement circuit 90*a* is set to E2. Then, the bias output characteristics based on the surface potential measurement circuit 90*a* are expressed by the following equation (1):

$$Vdc=(E1-E2)\cdot V/(V1-V2)+E1-(E1-E2)\cdot V1/(V1-V2) \quad (1)$$

where Vdc is the bias generation value outputted based on the surface potential measurement circuit reference, and V is the bias setting value inputted from the apparatus control portion 95 in order to generate Vdc.

Figure 6A:
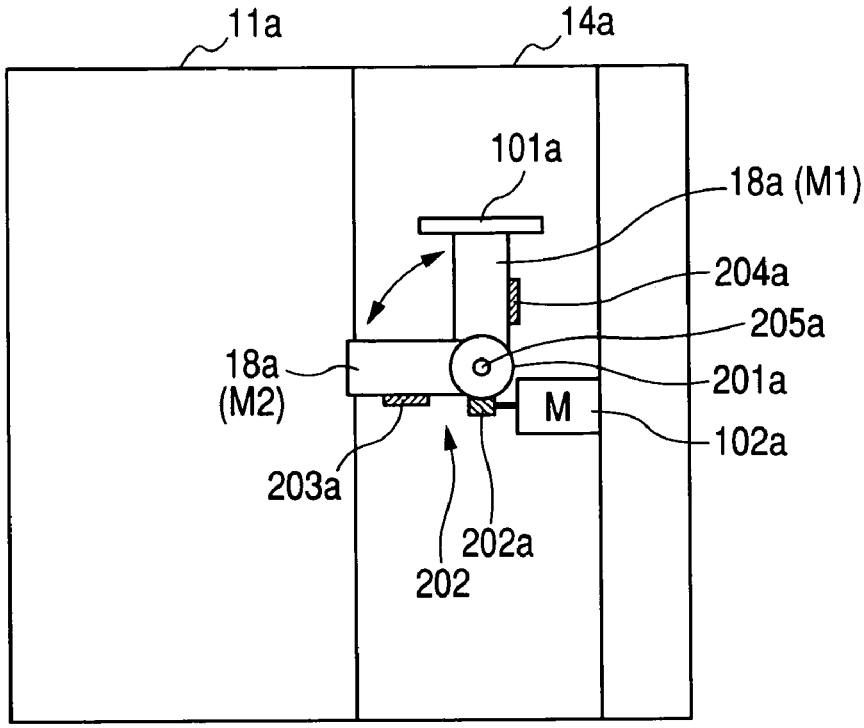
FIGS. 6A and 6B are structural drawings for explaining the first embodiment.
Figure 6B:
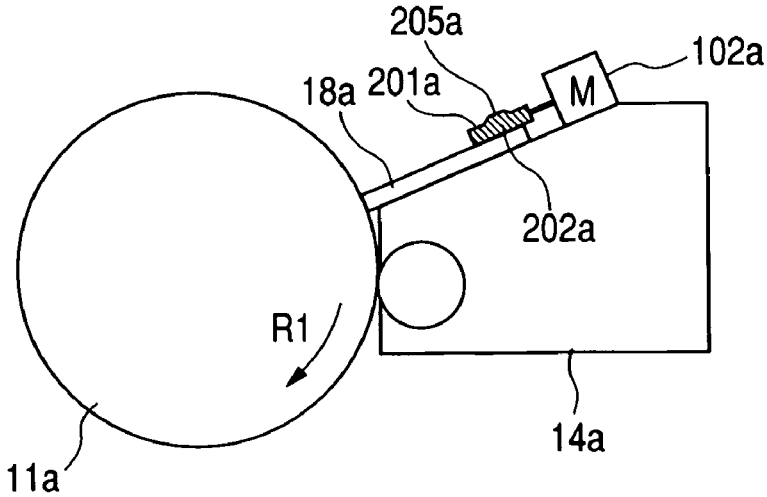

FIGS. 6A and 6B show a mechanism model for realizing the first embodiment. The mechanism model includes the surface potential sensor 18*a* and the development bias measurement electrode 101*a*. FIG. 6A is a top view, and FIG. 6B is a side view. FIGS. 6A and 6B show the case in which the surface potential sensor 18*a* is attached to the development device 14*a*. A bearing gear 201*a* around which a gear is formed is attached to the surface potential sensor 18*a*. A shaft 205*a*, a gear 202*a*, and the motor 102*a* are attached to the development device 14*a*. The bearing gear 201*a* is attached to the shaft 205*a*. The gear 202*a* transmits power to the bearing gear 201*a*. The motor 102*a* rotates the gear 202*a*. A stopper 203*a* and a stopper 203*a* are also provided. The stopper 203*a* securely stops the surface potential sensor 18*a* at the surface potential measurement position M2 which is located opposite to the surface of photoconductor drum 11*a*. The stopper 204*a* securely stops the surface potential sensor 18*a* at the development bias measurement position M1 which is located opposite to the development bias measurement electrode 101*a*. Namely, the development bias measurement electrode 101*a* is attached at the position opposite to the position (development bias measurement position) where the surface potential sensor 18*a* is stopped by the stopper 204*a*. A switch mechanism 202 is formed by the bearing gear 201*a* the shaft 205*a*, the gear 202*a*, the motor 102*a*, the stoppers 203*a* and 204*a*, and the like.

Thus, only the apparatus control portion 95 sets the rotating direction of the motor 102*a* to rotate the motor 102*a*, which allows the apparatus control portion 95 to switch the measurement objects of the surface potential sensor 18*a*.

As described above, according to the first embodiment, the same surface potential measurement circuit 90*a* can selectively measure the surface potential at the photoconductor drum 11*a* and the generation potential at the development bias by switching the surface potential sensor 18*a*. Therefore, the generation voltage at the development bias circuit 70*a* can be corrected based on the surface potential measurement circuit reference, and all the changes in detection result caused by the variation in components used for the bias detection portion and the temperature change can be corrected based on the surface potential measurement system reference. Namely, the dark section potential VD, the light section potential VL and the development bias Vdc are measured based on the surface potential measurement system reference, which allows the variations in contrast potential Vcont to be eliminated to realize the stable contrast potential Vcont. As a result, the image forming apparatus which reduces the fluctuation in image density and the fluctuation in color tint can be realized.

Further, according to the configuration of the first embodiment, the measurement of surface potential at the photoconductor drum 11*a* and the correction of the generation bias of the development bias circuit 70*a* are performed using the same bias detection portion 93*a* and the same A/D conversion portion 97*a*, so that the shifts caused by the quantization error of the A/D conversion portion 97*a* become the same characteristics. When compared with the case in which the A/D conversion portions are separately prepared for the measurement of surface potential and the correction of the generation bias, the shifts caused by the quantization error can also be taken in the surface potential measurement system reference. Therefore, the influences caused by the quantization errors on the contrast potentials Vcont can be eliminated, and the stable image density and color tint can be realized.

The development bias is described as an example of the correction object of the surface potential measurement system reference in the first embodiment. However, the invention is not limited to the first embodiment. For example, the invention can also be applied to the bias control circuit for the primary grid 17*a* (see FIG. 2). In this case, the dark section potential VD can stably set, and the higher-accuracy contrast potential Vcont and fog eliminating potential Vback can be set, so that the image forming apparatus, in which the fog is decreased and the fluctuation in image density is decreased, can be realized.

Second Embodiment

Figure 7:
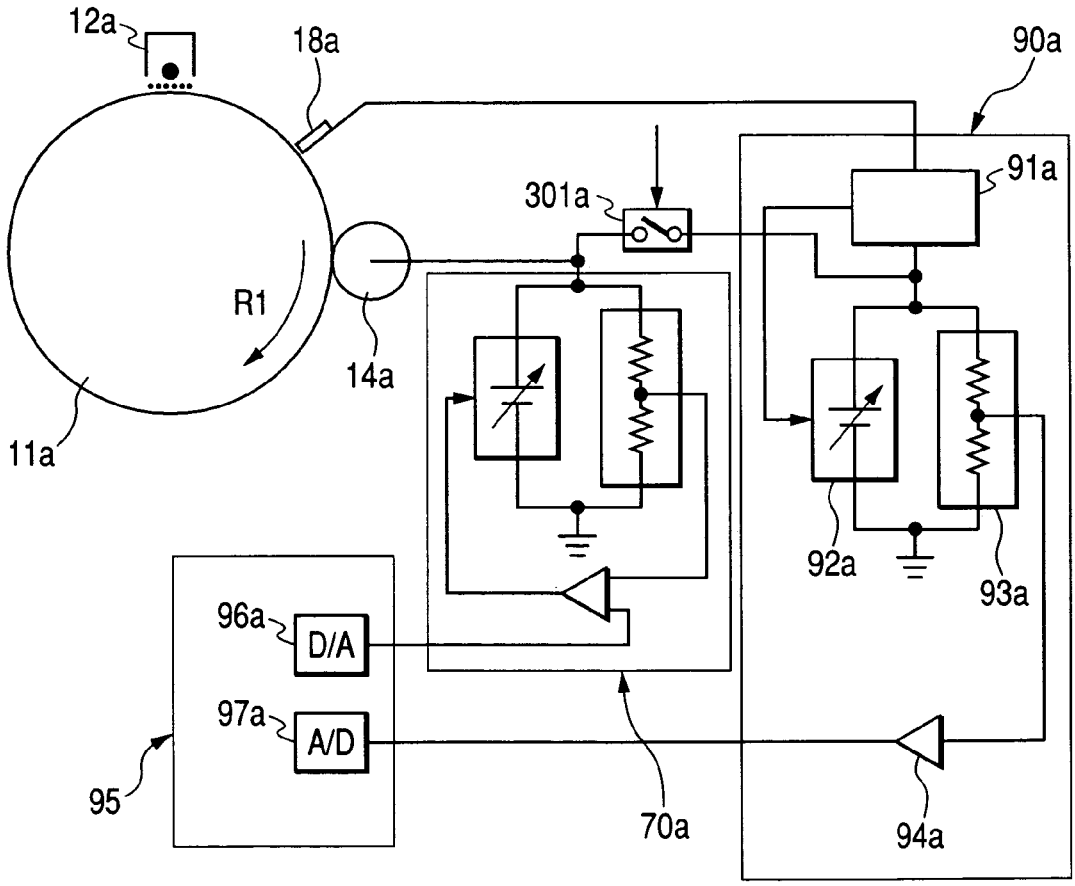
FIG. 7 shows an electric block diagram for explaining a second embodiment.

FIG. 7 shows a schematic configuration of an image forming apparatus (according to a second embodiment) of the invention.

In FIG. 7, the reference numeral 301*a* denotes high-voltage switch means. The high-voltage switch means 301*a* is configured to connect the development bias generation portion 70*a* to a measurement point of the sensor generation bias detection portion 93*a* in the surface potential measurement circuit 90*a* in response to the direction from the apparatus control portion 95.

In the configuration shown in FIG. 7, the apparatus control portion 95 turns on the high-voltage switch 301*a*, and the apparatus control portion 95 set a predetermined bias output value in the development bias circuit 70*a*. In response to the direction from the apparatus control portion 95, the development bias circuit 70*a* performs the bias generation control according to the setting value. Therefore, the output according to the set bias value is generated in the development device 14*a*, and the output is applied to the sensor generation bias detection portion 93*a* through the high-voltage switch 301*a*.

On the other hand, at this point, the apparatus control portion 95 control the sensor direct-current bias generation portion 92*a* to the stop state. Therefore, the measurement system (sensor bias detection portion 93*a* and A/D conversion portion 97*a*) in the surface potential measurement circuit 90*a* becomes the configuration for measuring the generation output of the development bias circuit 70*a*.

In the configuration described above, the apparatus control portion 95 performs the control by switching the plural generation bias values of the development bias circuit 70*a*, and the measurement system in the surface potential measurement circuit 90*a* measures each of the set generation outputs of the development bias circuit. Therefore, as with the first embodiment, the generation bias of the development bias circuit 70*a* can be corrected by the measurement system reference of the surface potential measurement circuit, the same effect as the first embodiment can be obtained.

It is possible that a mechanical relay or a semiconductor relay is used as the high-voltage switch 301*a*. It is also possible to form a switch circuit with a high-voltage transistor and the like.

Third Embodiment

Figure 8:
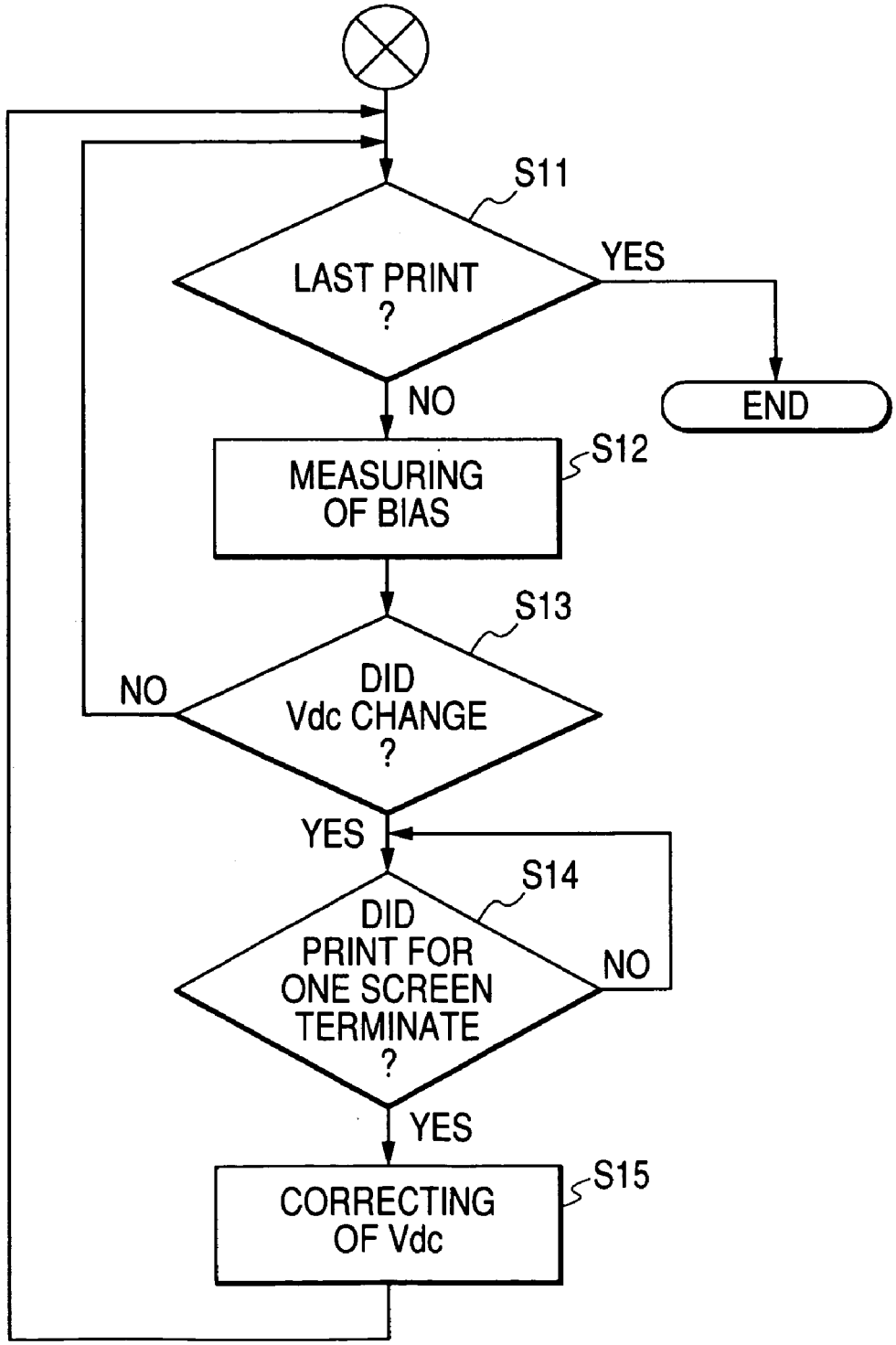
FIG. 8 is a flowchart for explaining a third embodiment.

FIG. 8 is a flowchart for explaining the apparatus control in an image forming apparatus (according to a third embodiment) of the invention.

In the third embodiment, the predetermined bias is measured by the surface potential measurement system during the continuous print, and the apparatus control portion performs the correction control to the objective bias circuit when the shift from the surface potential measurement system is generated.

First it is determined whether the last print is performed or not (Step S11). When the last print is performed (Yes in Step S11), the control flow is ended. When the last print is not performed (No in Step S11), the objective bias is measured by the surface potential measurement system (Step S12).

Then, it is determined whether the measured bias value is changed or not (Step S13). When the measured bias value is not changed (No in Step S13), it is determined that the difference in detection result does not exist between the surface potential measurement system and the bias control system, and the control flow returns to Step S11. When the measured bias value is changed (Yes in Step S13), it is determined that difference in characteristics of the detection portion is generated between the surface potential measurement system and the bias control system, and the control flow goes to Step S14. In Step S14, the termination of the print for one screen is waited. In Step S15, the objective bias output is changed to the control bias value in which the surface potential measurement system is set to the reference. At this point, the one-time maximum value in the correction is determined so that the setting is not extremely changed before and after the bias output is changed, and the correction is performed based on the maximum value. Therefore, the stable image quality can be realized without extremely changing the print quality.

The correction object is not described in the third embodiment. However, the correction is performed in the development bias, the primary grid bias, the primary charge in the case when the primary charge is formed by a roller charge system, and the like. From a safety standpoint of the circuit, the measurement object of the surface potential measurement system is switched when the bias output is stopped.

Fourth Embodiment

Figure 9:
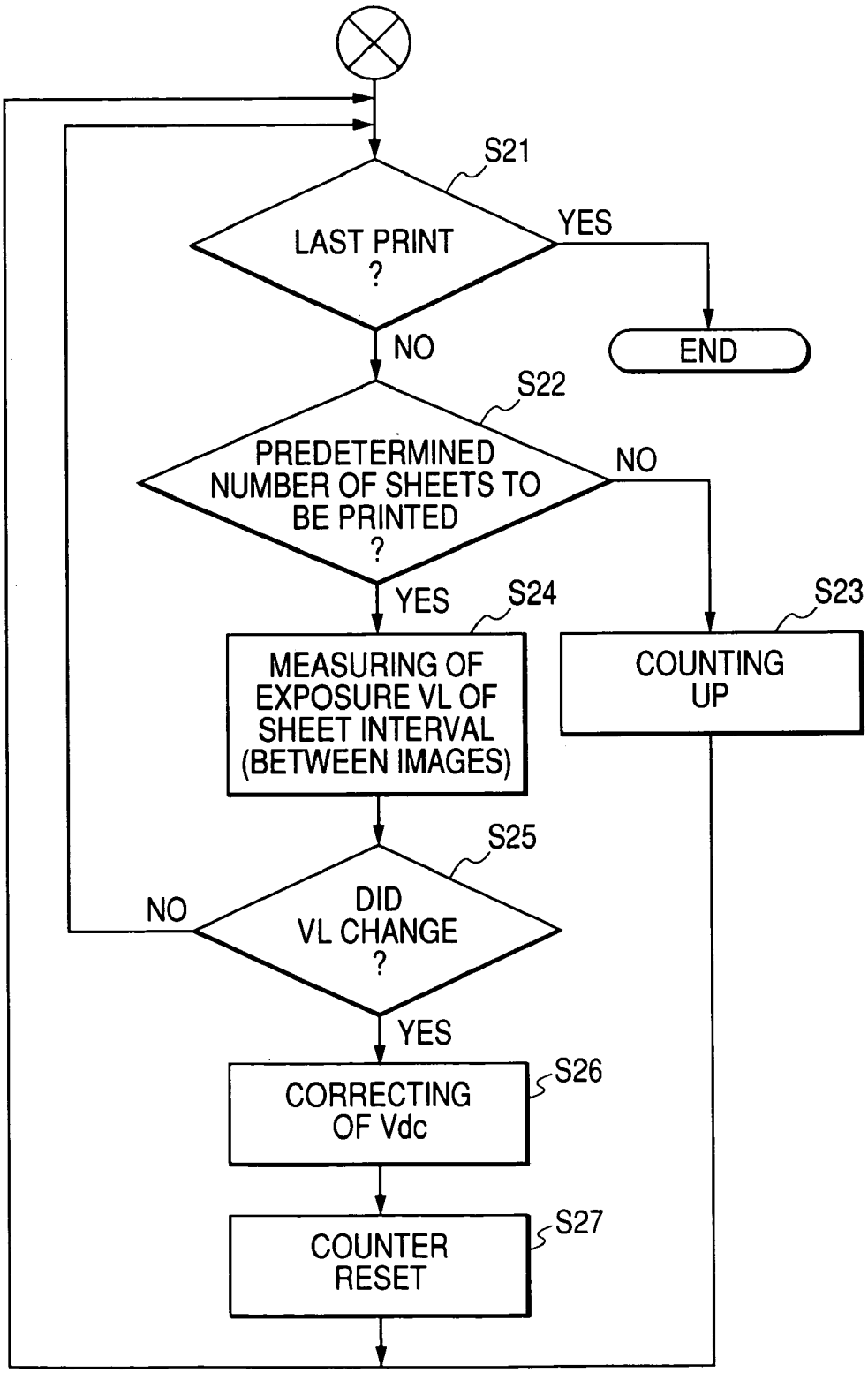
FIG. 9 is a flowchart for explaining a fourth embodiment.

FIG. 9 is a flowchart for explaining the apparatus control in an image forming apparatus according to a fourth embodiment of the invention.

In the fourth embodiment, the light section potential VL is measured during the continuous print, and the apparatus control portion performs the correction control to the development bias circuit when the light section potential VL is generated.

First it is determined whether the last print is performed or not (Step S21). When the last print is performed (Yes in Step S21), the control flow is ended. When the last print is not performed, it is determined whether the predetermined number of sheets is reached or not (Step S22). When the predetermined number of sheets is not reached (No in Step S22), a sheet counter is incremented (Step S23), and the control flow returns to Step S21. When the predetermined number of sheets is reached (Yes in Step S22), the light section potentials VL are measured between the images (Step S24). At this point, the development bias output is tuned off so that the fog image is not generated on the photoconductor drum, and then the exposure is performed.

Then, it is determined whether the light section potential VL is changed or not (Step S25). When the light section potential VL is not changed (No in Step S25), the sheet counter is reset, and the control flow returns to Step S21. When the light section potential VL is changed (Yes in Step S25), the generation bias value of the development bias circuit is measured by the surface potential measurement system, and the generation bias setting value of the development bias circuit is changed so that the contrast potential Vcont is kept constant in agreement with the measured light section potential VL (Step S26). Then, the sheet counter is reset (Step S27), and the control flow returns to Step S21.

In the control of the fourth embodiment, in order to measure the light section potential VL, the development bias is turned off, the exposure is performed, and then the light section potential VL is measured. Further, it is necessary to start up the development bias Vdc (sometimes the setting is changed). Therefore, sometimes the control of the fourth embodiment cannot be realized between the images. In this case, the control is performed so that the start of printing the next image is delayed.

As described above, according to the fourth embodiment, while image writing is delayed during the continuous print if necessary, the light section potential VL is measured to correct the development bias Vdc. Therefore, the same effect as the third embodiment can be obtained.

As with the third embodiment, the image forming apparatus of the fourth embodiment is configured to set the upper limit value in the correction of the development bias Vdc so that the rapid change in image density is not generated.

From a safety standpoint of the circuit, it is desirable that the switch between the measurement of the generation bias in the development bias circuit and the measurement of the light section potential VL is performed at timing during which the generation bias of the development bias circuit is turned off when the photoconductor drum surface potential becomes the minimum potential at the light section potential VL.

Fifth Embodiment

Figure 10:
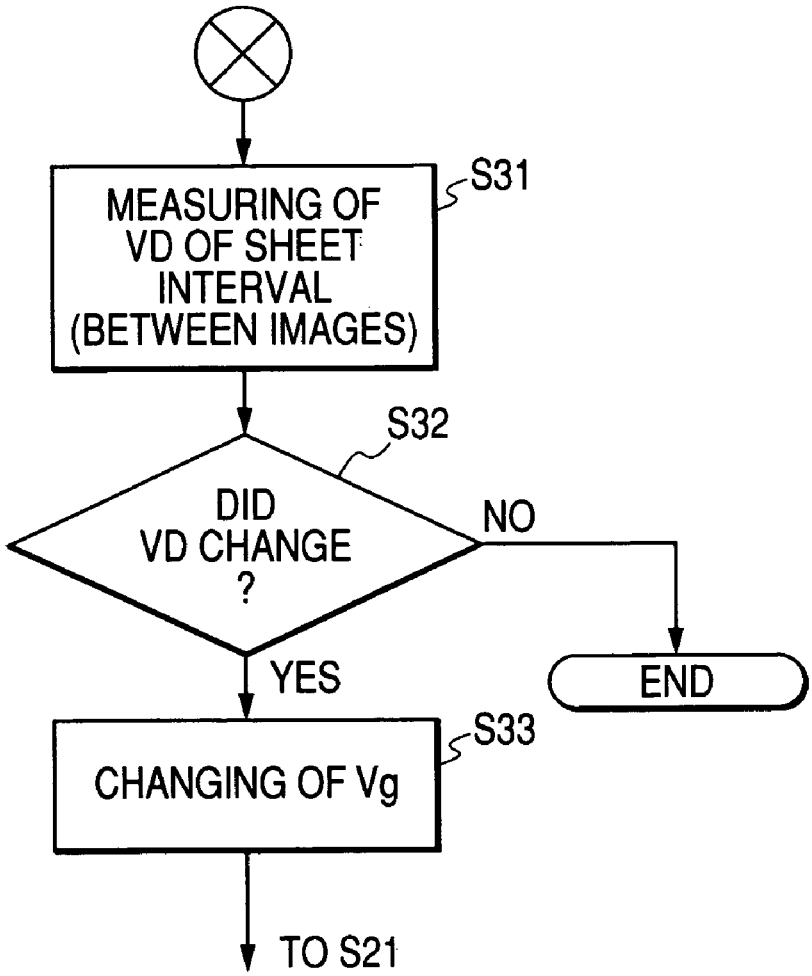
FIG. 10 is a flowchart for explaining a fifth embodiment.

FIG. 10 is a flowchart for explaining the apparatus control in an image forming apparatus (according to a fifth embodiment) of the invention.

In the fifth embodiment, the dark section potential VD is measured during the continuous print, and the apparatus control portion performs the correction control to the primary grid circuit when the dark section potential VD is generated.

The dark section potential VD is measured (Step S31). The measurement can be performed between the images (sheet interval). It is determined whether the measured dark section potential VD is changed or not (Step S32). When the dark section potential VD is not changed, the flow is ended. When the dark section potential VD is changed, the setting potential Vg of the primary grid is changed (Step S33), and the control from Step S21 in the flowchart shown in FIG. 9 in the fourth embodiment is performed.

According to the control of the fifth embodiment, when the dark section potential VD measured by the surface potential measurement system is generated by the shift from the measurement system of the primary grid circuit due to the temperature change, the output of the primary grid circuit can instantly be adjusted, which allows the contrast potential Vcont and the fog eliminating potential Vback to be kept constant based on the surface potential measurement system in conjunction with the control shown in the fourth embodiment. Therefore, in addition to the effects shown in the third and fourth embodiments, the image fog can be prevented from generating by the stabilization of the fog eliminating potential Vback.

Sixth Embodiment

Figure 11:
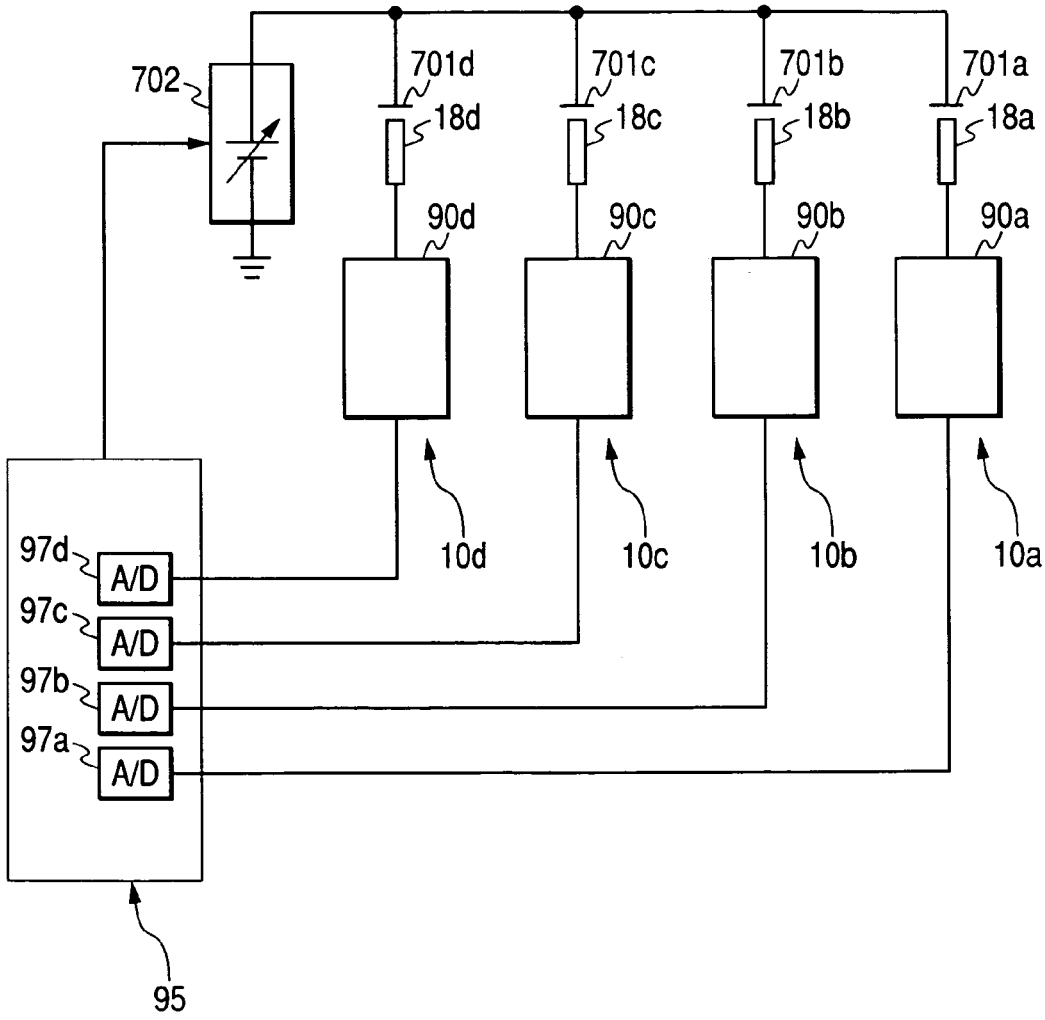
FIG. 11 is a block diagram for explaining a sixth embodiment.

FIG. 11 is a block diagram for explaining an image forming apparatus (according to a sixth embodiment) of the invention.

In FIG. 11, the reference numerals 18*a*, 18*b*, 18*c*, and 18*d* denote surface potential sensors corresponding to the photoconductor drums 11*a*, 11*b*, 11*c*, and 11*d* (see FIG. 1). The reference numerals 90*a*, 90*b*, 90*c*, and 90*d* denote surface potential measurement circuits. The reference numerals 97*a*, 97*b*, 97*c*, and 97*d* denote A/D conversion portions which are provided in the apparatus control portion 95. The reference numerals 701*a*, 701*b*, 701*c*, and 701*d* denote measurement electrodes which are fixed at the surface potential measurement positions opposite the surface potential sensors 18*a* to 18*d* respectively. The reference numeral 702 denotes a reference power supply (reference bias generation means) which is commonly connected to the measurement electrodes 701*a* to 701*d*.

The surface potential sensors 18*a* to 18*d* are configured to be able to switch the measurement positions of the measurement electrodes 701*a* to 701*d* and the surface potential measurement position of the photoconductor drums 11*a* to 11*d* respectively.

In the configuration shown in FIG. 11, the apparatus control portion 95 causes the reference power supply 702 to output the predetermined bias. The output bias is commonly applied to the measurement electrodes 701*a* to 701*d*, and the surface potential measurement circuits 90*a* to 90*d* convert the applied bias into the detection signals through the surface potential sensors 18*a* to 18*d*. The detection signals are transmitted to the A/D conversion portions 97*a* to 97*d* corresponding to the surface potential sensors 18*a* to 18*d*, and the detection signals are digitalized. Then, the digitalized detection signal is processed by the apparatus control portion 95. The above control is repeated in plural times by changing the setting voltage of the reference power supply 702, which allows the detection characteristics in each measurement system to be obtained.

Then one of the measurement systems is selected as a representative, and the detection characteristics of other measurement systems are corrected based on the detection characteristics of the selected measurement system. When the above correction sequence is repeated at proper timing, the temperature change and the variation with time of the detection characteristics in each measurement system can be integrated into the same the temperature change and the same variation with time of the detection characteristics in the specific measurement system. Therefore, the density change caused by the variation in characteristics of each measurement system can become equal in the image forming portions, and the variations in color tint of the color images can be suppressed to the minimum level.

Various methods can be cited as the correction method. For example, the correction can be achieved using the linear approximation by the two-point measurement described in the first embodiment.

Seventh Embodiment

Figure 12:
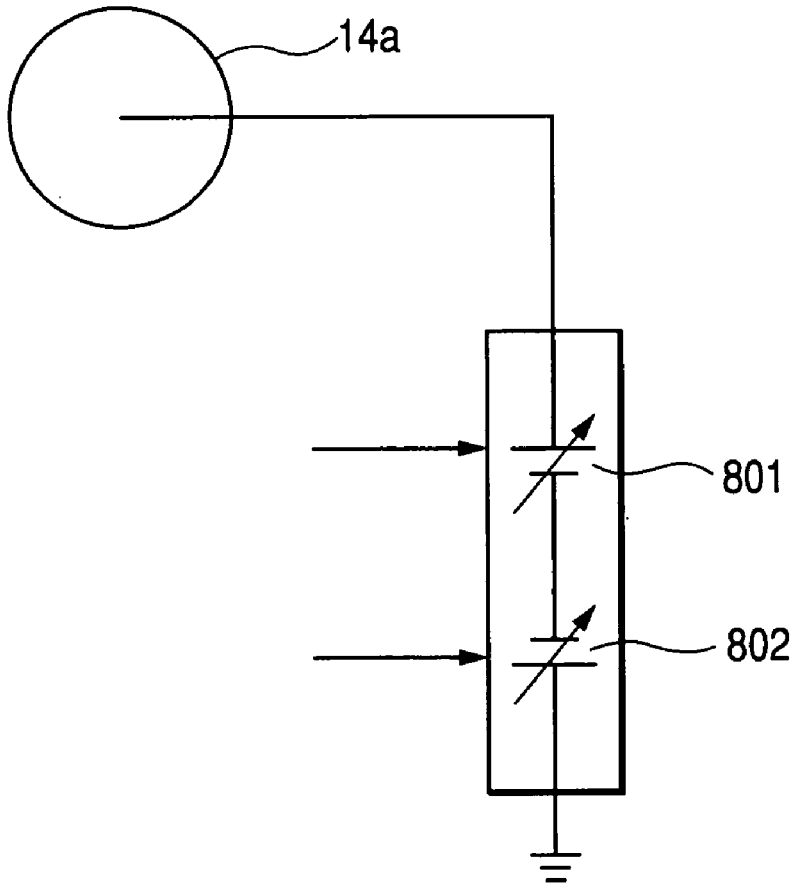
FIG. 12 is a block diagram for explaining a seventh embodiment.
Figure 13:
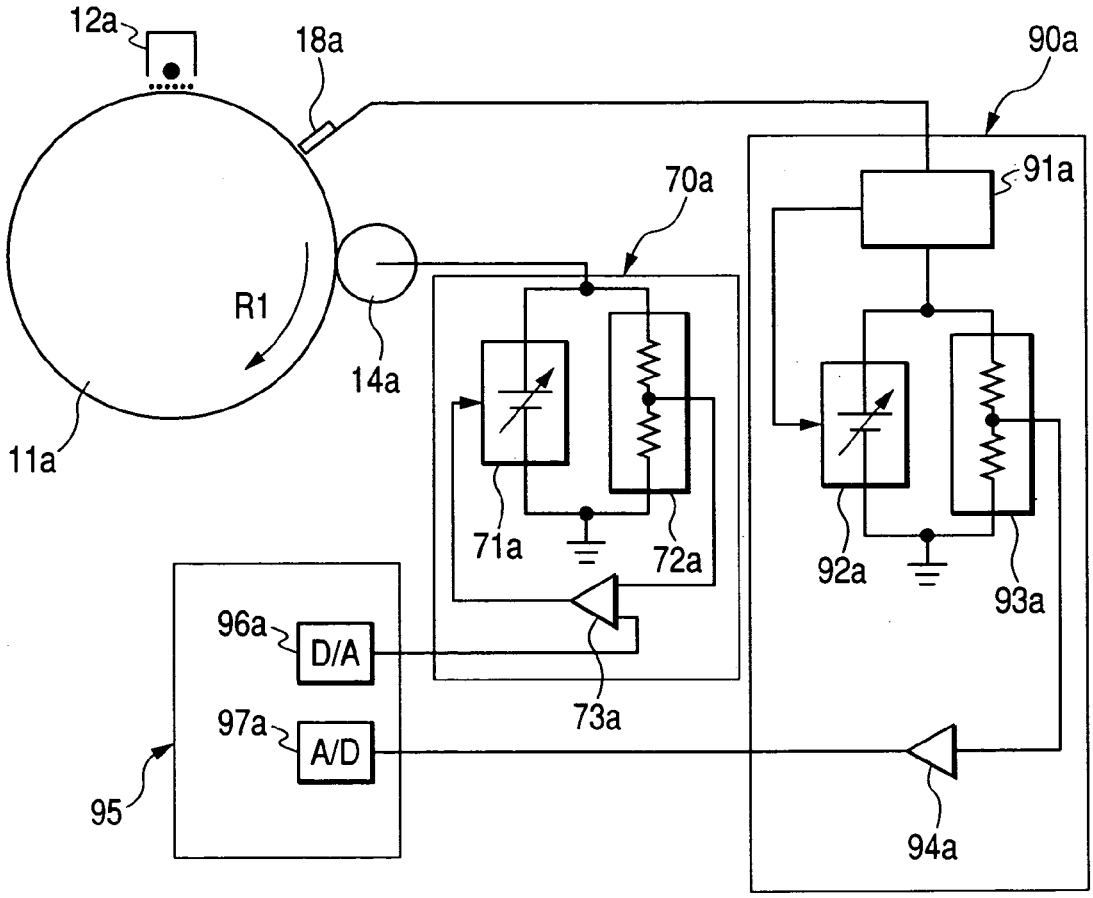
FIG. 13 shows an electric block diagram for explaining the conventional image forming apparatus.

FIG. 12 is a block diagram of a development bias circuit for explaining an image forming apparatus (according to a seventh embodiment) of the invention.

In FIG. 12, the reference numeral 801 denotes a development bias generation circuit (first polarity bias generation means) which develops the electrostatic latent image into the toner image, and the reference numeral 802 denotes a fog removing bias generation circuit (second polarity bias generation means) which generates the bias output different from that of the development bias generation circuit 801.

In the configuration shown in FIG. 12, the development bias generation circuit 801 is used for the development of the electrostatic latent image. On the other hand, the fog removing bias generation circuit 802 is used during the measurement of the light section potential VL. According to the fourth embodiment in which the light section potential VL is measured during the continuous print to correct the development bias Vdc, in order to measure the light section potential VL during the continuous print, it is desirable that the development device is configured so as not is be detachable due to the print speed of the apparatus. In the configuration in the current status, when the potential at the photoconductor drum surface falls to the light section potential VL without detaching the development device, there is the problem that the fog toner is developed in the photoconductor drum even if the development bias is turned off. The problem should be solved in the invention in which the light section potential VL is frequently measured. Therefore, in the seventh embodiment, the fog removing bias generation circuit 802 is provided in the development bias circuit 801, and the development bias Vdc is set to the reverse polarity during the measurement of the light section potential VL to avoid the adhesion of the fog toner to the photoconductor drum.

In the first embodiment to the seventh embodiment, during the image forming process, the photoconductor drum surface is charged in the positive polarity, and the high density portion of the image is exposed to form the image. However, the invention is not limited to the above embodiments. For example, the invention can be applied to a negative polarity charge system and a background exposure system in which the background of the image is exposed. The same effects can be obtained when the invention is applied to other systems except for the positive polarity charge system.

This application claims priority from Japanese Patent Application No. 2004-085804 filed Mar. 23, 2004, which is hereby incorporated by reference herein.

What is claimed is:

1. An image forming apparatus comprising:

an image bearing body which can bear an electrostatic image;

a bias member which is disposed opposite to said image bearing body and to which a predetermined bias is applied;

bias means which applies the predetermined bias to said bias member;

surface potential detection means which detects a surface potential at said image bearing body, said surface potential detection means including a detector portion which generates a signal according to a potential difference between said detector portion and a surface of said image bearing body, a detection bias generation portion which applies a bias to said detector portion according to a signal from said detector portion such that a potential at said detector portion becomes equal to a surface potential at said image bearing body, and a potential detection portion which detects the bias generated by said detection bias generation portion, wherein said potential detection portion is also used for detection of a bias value which said bias means applies to said bias member; and control means which controls said bias means based on a detection result of the bias value which said bias means applies to said bias member, the detection result being obtained by said potential detection portion.

2. The image forming apparatus according to claim 1, wherein said detector portion is configured to be able to detect the surface potential of said image bearing body and a surface potential at an electrode portion to which the predetermined bias is applied.

3. The image forming apparatus according to claim 2, wherein said detector portion is configured to be able to be moved between a position opposite to said image bearing body and a position opposite to said electrode portion to which the predetermined bias is applied.

4. The image forming apparatus according to claim 1, further comprising switch means which is able to apply the bias applied from said bias means to said potential detection portion, wherein said switch means is operated such that the bias is applied from said bias means to said potential detection portion when said potential detection portion detects said bias means.

5. The image forming apparatus according to claim 4, wherein said detection bias generation portion is placed in an inactive state when said potential detection portion detects said bias means.

6. The image forming apparatus according to claim 1, wherein said bias member is a developing agent bearing body which bears and conveys a developing agent for developing the electrostatic image.

7. The image forming apparatus according to claim 1, wherein said bias member is one which includes charging means which uniformly charges the surface of said image bearing body.

* * * * *

UNITED STATES PATENT AND TRADEMARK OFFICE

CERTIFICATE OF CORRECTION

PATENT NO. : 7,158,733 B2
APPLICATION NO. : 11/078368
DATED : January 2, 2007
INVENTOR(S) : Koji Doi et al.

It is certified that error appears in the above-identified patent and that said Letters Patent is hereby corrected as shown below:

COLUMN 3:
Line 19, “since” should be deleted.
Line 47, “including:” should read --includes:--.
Line 50, “an” should read --a--.
Line 52, “applys” should read --applies--.

COLUMN 4:
Line 67, “hotoconductor drum” should read --photoconductor drum”)--.

COLUMN 5:
Line 11, “to 11a.” should read --to 11d.--.
Line 43, “to 11a.” should read --to 11d.--.
Line 63, “transfer” should read --transfers--.

COLUMN 6:
Line 16, “to 11a.” should read --to 11d.--.

COLUMN 7:
Line 6, “indicates” should read --indicate--.
Line 56, “refeffed” should read --referred--.

COLUMN 9:
Line 31, “stopper 203a” (second occurrence) should read --stopper 204a--.

COLUMN 10:
Line 26, “can stably” should read --can be stably--.
Line 44, “set” should read --sets--.
Line 54, “control” should read --controls--.

UNITED STATES PATENT AND TRADEMARK OFFICE

CERTIFICATE OF CORRECTION

PATENT NO. : 7,158,733 B2
APPLICATION NO. : 11/078368
DATED : January 2, 2007
INVENTOR(S) : Koji Doi et al.

It is certified that error appears in the above-identified patent and that said Letters Patent is hereby corrected as shown below:

COLUMN 13:
Line 30, "apparatus," should read --apparatus--.

Signed and Sealed this

Thirty-first Day of July, 2007

JON W. DUDAS
*Director of the United States Patent and Trademark Office*